United States Patent [19]

Fujita

[11] Patent Number: 4,610,224

[45] Date of Patent: Sep. 9, 1986

[54] CONFIGURATION FOR V TYPE DOUBLE OVERHEAD CAM SHAFT ENGINE UTILIZING INTERCHANGABLE INTAKE CAM SHAFTS AND INTERCHANGABLE EXHAUST CAM SHAFTS

[75] Inventor: Hiroya Fujita, Toyota, Japan

[73] Assignee: Toyota Jidosha Kabushiki Kaisha, Aichi, Japan

[21] Appl. No.: 780,609

[22] Filed: Sep. 26, 1985

[30] Foreign Application Priority Data

Dec. 20, 1984 [JP] Japan ..... 59-269177

[51] Int. Cl.[4] ..... F01L 1/02

[52] U.S. Cl. ..... 123/90.31; 123/90.27; 123/DIG. 7

[58] Field of Search ..... 123/90.31, 90.27, DIG. 6, 123/DIG. 7, DIG. 8

[56] References Cited

U.S. PATENT DOCUMENTS

| | | | |
|---|---|---|---|
| 3,673,990 | 4/1972 | Alfieri | 123/90.31 |
| 3,732,745 | 5/1973 | Jackson | 123/90.27 |
| 4,380,216 | 4/1983 | Kandler | 123/90.31 |
| 4,480,603 | 11/1984 | Tsuboi | 123/90.31 |

*Primary Examiner*—Ira S. Lazarus

*Attorney, Agent, or Firm*—Parkhurst & Oliff

[57] ABSTRACT

A configuration for a V type double overhead cam shaft engine which has left and right cylinder banks and cylinder heads. Left and right intake cam shafts are fitted to the left and right cylinder heads. The left intake cam shaft is substantially identically formed to the right intake cam shaft and is fitted in reversed alignment thereto. Similarly, left and right exhaust cam shafts are fitted to the left and right cylinder heads, and the left exhaust cam shaft is substantially identically formed to the right exhaust cam shaft and is fitted in reversed alignment thereto. One pair of the same type of the cam shafts are driven in a determinate phase relationship with the engine crank shaft. A pair of gears, with the same number of teeth, are provided on the left intake and exhaust cam shafts, and mesh together so as to rotationally couple together them in a determinate phase relationship. Similarly, a pair of gears, with the same number of teeth, are provided on the right intake and exhaust cam shafts, and mesh together so as to rotationally couple together them in a determinate phase relationship. At the left and right cylinder banks, the number n of teeth of the phase difference of the pairs of gears is determined by the equation $n=(\text{gamma}/180°)N$, where gamma is the phase difference angle of the intake and exhaust cam shafts, and N is the number of teeth on the gears. The engine may be a six cylinder engine.

2 Claims, 5 Drawing Figures

CONFIGURATION FOR V TYPE DOUBLE OVERHEAD CAM SHAFT ENGINE UTILIZING INTERCHANGABLE INTAKE CAM SHAFTS AND INTERCHANGABLE EXHAUST CAM SHAFTS

BACKGROUND OF THE INVENTION

The present invention relates to the field of V configuration double overhead cam shaft internal combustion engines, and in particular to a configuration for such a V configuration double overhead cam shaft engine in which the number of different parts required is reduced.

Generally, a V type double overhead cam shaft engine is provided with a left cylinder band and a right cylinder bank; when the engine is of V6 configuration, there are three cylinders in each of said right and said left bank, while, when the engine is of V8 configuration, there are four cylinders in each of said right and said left bank. The left cylinder bank has a left intake cam shaft and a left exhaust cam shaft (since the engine is particularly of the double overhead cam shaft type), while similarly the right cylinder bank has a right intake cam shaft and a right exhaust cam shaft; thus, in all, four cam shafts are provided to the engine, two intake and two exhaust. And each of the right and left cylinder banks has its set of intake valves and its set of exhaust valves, and these are respectively controlled with regard to their opening and closing by the intake and the exhaust cam shaft for said cylinder bank.

Now, although such V type double overhead cam shaft engines have conspicuous advantages in terms of performance, which make them particularly suitable for modern automobiles, they suffer from the disadvantage that they require a comparatively large number of parts, as compared with straight or in line type internal combustion engines, such as for example straight six engines. This proliferation of parts is particularly problematical in the valve gear of such V type double overhead cam shaft engines. Further, the number of different types of parts utilized in a V type double overhead cam shaft engine in the prior art tended to be much greater than in a straight type engine, and this gives problems with regard to convenience of manufacture of such an engine, loss of economies of scale, and stocking of spare parts.

In particular, such a V type double overhead cam shaft engine has in the past required its four cam shafts to be manufactured as individual parts, each differently made from the other three. Thus, four different types of cam shaft have been required to be manufactured for making the V type double overhead cam shaft engine, and this has been a serious problem in view of cost and inconvenience during manufacture and assembly. And, as suggested above, during operation of this V type double overhead cam shaft engine, service depots have been required to stock four different kinds of cam shaft for said engine, which is troublesome, burdensome, a likely cause or error, and expensive from the stocking point of view.

SUMMARY OF THE INVENTION

It might be conceived of simply to manufacture the left and the right intake cam shafts as identical and therefore interchangable, and similarly to manufacture the left and the right exhaust cam shafts as identical and interchangable. This concept however by itself would be quite inadequate, since problems arise with regard to the correct phasing of the cam lobes of the right and left cylinder banks, and the timing of the opening and closing of the intake and exhaust valves becomes improper, and accordingly firing at regular intervals of the engine is compromised. However, the present inventor has conceived that, by varying the arrangement of the cam shafts as well as varying their fitted phase, these problems might be overcome.

Accordingly, it is the primary object of the present invention to provide a configuration for a V type double overhead cam shaft engine which overcomes the above outlined problems.

It is a further object of the present invention to provide such a configuration for such an engine which allows the two intake cam shafts for the left and right cylinder banks to be made as mutually interchangable parts, and likewise allows the two exhaust cam shafts to be made as mutually interchangable parts.

It is a further object of the present invention to provide such a configuration for such an engine which, while allowing the two intake cam shafts to be mutually interchangable and likewise allowing the two exhaust cam shafts to be mutually interchangable, preserves correct valve timing.

It is a further object of the present invention to provide such a configuration for such an engine which reduces the number of different parts required for the engine.

It is a further object of the present invention to provide such a configuration for such an engine which makes engine manufacture easier.

It is a yet further object of the present invention to provide such a configuration for such an engine which makes engine manufacture less prone to error.

It is a yet further object of the present invention to provide such a configuration for such an engine which makes engine manufacture more economical.

It is a yet further object of the present invention to provide such a configuration for such an engine which makes stocking of engine parts more efficient and economical.

It is a yet further object of the present invention to provide such a configuration for such an engine which reduces the likelihood of engine parts stocking errors.

According to the most general aspect of the present invention, these and other objects are accomplished by a configuration for a V type double overhead cam shaft engine comprising a crank shaft, a left cylinder bank with a left bank cylinder head, and a right cylinder bank with a right bank cylinder head, wherein: (a) a left bank intake cam shaft is fitted to said left bank cylinder head and a right bank intake cam shaft is fitted to said right bank cylinder head, said left bank intake cam shaft being substantially identically formed to said right bank intake cam shaft and being fitted in reversed alignment thereto; (b) a left bank exhaust cam shaft is fitted to said left bank cylinder head and a right bank exhaust cam shaft is fitted to said right bank cylinder head, said left bank exhaust cam shaft being substantially identically formed to said right bank exhaust cam shaft and being fitted in reversed alignment thereto; (c) a pair of the same type of said cam shafts are driven in a determinate phase relationship with said engine crank shaft; (d) a pair of left bank gears, with the same number of teeth, are provided one on said left bank intake cam shaft and one on said left bank exhaust cam shaft, and mesh together so as to rotationally couple together said left bank intake cam shaft and said left bank exhaust cam shaft in a determinate phase relationship; (e) a pair of right bank gears, with the same number of teeth, are provided one on said right bank intake cam shaft and one on said right bank exhaust cam shaft, and mesh together so as to rotationally couple together said right bank intake cam shaft and said right bank exhaust cam shaft in a determinate phase relationship; and (f) at said left cylinder bank and at said right cylinder bank, the number n of teeth of the phase difference of said pairs of gears is determined by the equations: $n=(gamma/180°)N$, where gamma is the phase difference angle of the intake cam shaft and the exhaust cam shaft, and N is the number of teeth on the gears.

According to such a structure, the engine is capable of effectuating the correct firing sequence for firing at regular intervals, while using two substantially identically formed intake cam shafts and two substantially identically formed exhaust cam shafts, one of each being used in the left cylinder bank and the other being used in the right cylinder bank in opposite alignment. In other words, the two intake cam shafts are fitted in their cylinder heads in axially reversed alignments, and similarly the two exhaust cam shafts are fitted in their cylinder heads in axially reversed alignments. And this engine is capable of providing correct opening and closing timing of its intake and its exhaust valves, in virtue of the establishing, in the manner defined above, of phase differences between the pairs of gears driving the driven ones of the intake and the exhaust cam shafts from the driving ones thereof. Accordingly, there is provided a configuration for a V type double overhead cam shaft engine which allows the two intake cam shafts for the left and right cylinder banks to be made as mutually interchangable parts, and likewise allows the two exhaust cam shafts to be made as mutually interchangable parts, and still preserves correct valve timing. Thus, this configuration reduces the number of different parts required for the engine, accordingly making engine manufacture easier and less prone to error. Thus, the engine manufacture is made more economical, as is the stocking of engine parts. Further, the likelihood of engine parts stocking errors is reduced.

Further, according to a more particular aspect of the present invention, these and other objects are more particularly and concretely accomplished by such a configuration for a V type double overhead cam shaft engine as described above, wherein engine is a six cylinder engine, with three cylinders in each of said left and right cylinder banks.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENT

Figure 1:
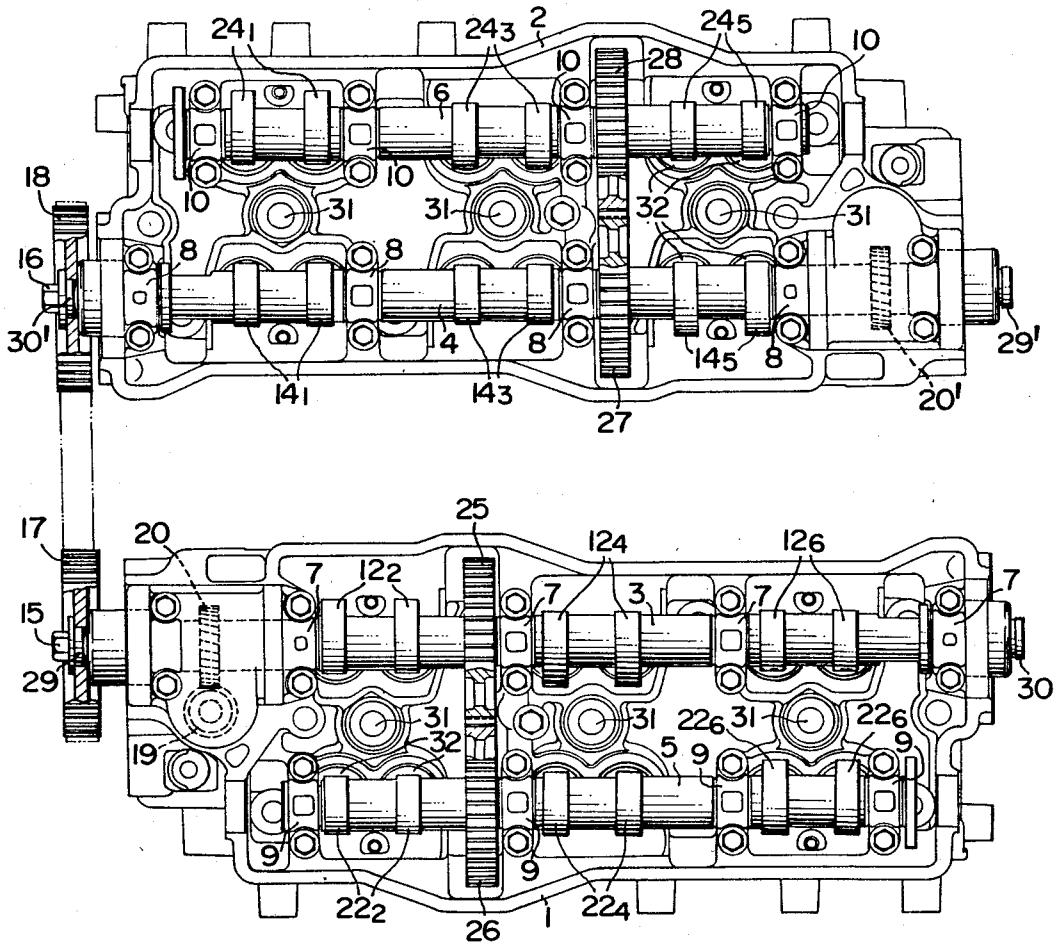
FIG. 1 is a schematic plan view of the left and right cylinder heads of a six cylinder V type double overhead cam shaft engine of configuration according to the preferred embodiment of the present invention.
Figure 2:
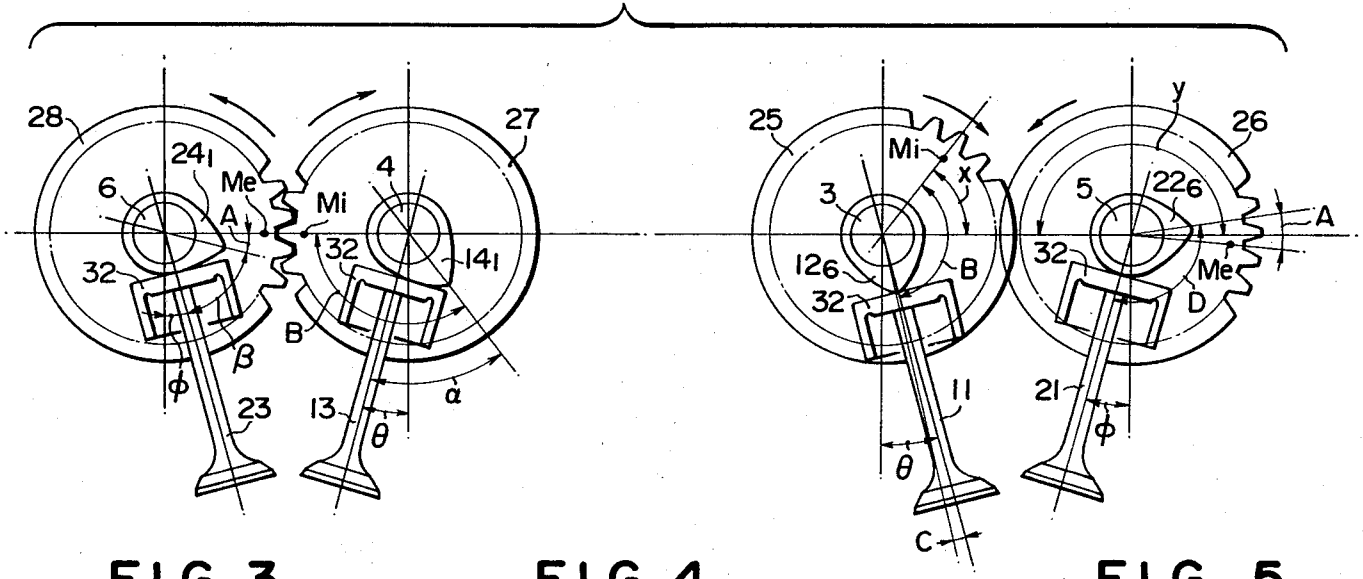
FIG. 2 is a schematic end on view of the intake and exhaust cam shafts of the left and right cylinder banks of the FIG. 1 engine, also showing sample ones of the intake and exhaust valves on each said bank.

The present invention will now be described with reference to the preferred embodiment thereof, and with reference to the appended drawings. FIG. 1 shows in plan view the left and right bank cylinder heads of a six cylinder V type double overhead cam shaft engine whose configuration is according to the preferred embodiment of the present invention. In these figures, the reference numeral 1 denotes the cylinder head for the left cylinder bank, while 2 denotes the cylinder head for the right cylinder bank. As is per se known in the field of V type internal combustion engines, these two cylinder heads 1 and 2 have a fixed bank angle, and when viewed from the front (this view is not particularly shown) have a mutually slanting V shaped configuration with a bank angle of 60°. The three cylinders in the left cylinder bank are cylinders numbers 2, 4, and 6 according to the usual method of cylinder numbering, and the three cylinders in the right cylinder bank are cylinders numbers 1, 3, and 5 according to the usual method of cylinder numbering. In FIG. 2, in the interests of simplicity of illustration, these two cylinder heads 1 and 2 are depicted as if deployed on a common plane, although in the real engine they are angled to one another. The left cylinder head 1 has six intake poppet valves 11 in a line and six exhaust poppet valves 21 in a line mounted therein, being two intake valves and two exhaust valves for each of the three cylinders numbers 2, 4 and 6 of the cylinder bank of said left cylinder head 1; but these valves are not visible in FIG. 1. And, similarly, the right cylinder head 2 has six intake poppet valves 13 in a line and six exhaust poppet valves 23 in a line mounted therein, being two intake valves and two exhaust valves for each of the three cylinders numbers 1, 3, and 5 of the cylinder bank of said right cylinder head 2, and these valves are not visible in FIG. 1 either.

On the left bank cylinder head 1, along the line of the six intake valves mounted therein and above said intake valves (thus concealing them from the point of view of FIG. 1), there is rotatably mounted by a plurality of cam shaft holding portions 7, 7 a left intake cam shaft 3, and similarly on said left bank cylinder head 1, along the line of the six exhaust valves mounted therein and above said exhaust valves, there is rotatably mounted by a plurality of other cam shaft holding portions 9, 9 a left exhaust cam shaft 5, parallel to said left intake cam shaft 3. And, similarly, on the right bank cylinder head 2, along the line of the six intake valves mounted therein and above said intake valves, there is rotatably mounted by a plurality of cam shaft holding portions 8, 8 a right intake cam shaft 4, and also on said right bank cylinder head 1, along the line of the six exhaust valves mounted therein and above said exhaust valves, there is rotatably mounted by a plurality of other cam shaft holding portions 10, 10 a right exhaust cam shaft 6, parallel to said right intake cam shaft 4. The left intake cam shaft 3 and the right intake cam shaft 4 are located on the inward sides of their cylinder heads with respect to the V shape of the two banks of cylinders, while the left exhaust cam shaft 5 and the right exhaust cam shaft 6 are located on the outward sides of their cylinder heads with respect to said V shape of the two banks of cylinders; this is done in order to simplify the structure of either the exhaust manifold or the intake manifold (neither of these are shown), as compared with the case in which the exhaust cam shafts and the intake cam shafts are arranged alternately.

In each of the left and right cylinder banks, and according to the disposition of the intake cam shafts 3 and 4 and the exhaust cam shafts 5 and 6 as will be described later, the cylinder heads 1 and 2 and the parts associated therewith are the same, but in longitudinally inverted arrangement: in other words, the left bank cylinder head 1 and the right bank cylinder head 2 are identical castings, but are arranged in a reversed fashion as can easily be seen from FIG. 1; and similarly all the various parts such as the valves, the cam shaft holding portions, etc., associated with said cylinder heads 1 and 2, are identical between the two left and right cylinder banks, but are arranged in an inverted fashion, front to back along the line of the cylinders.

Cam lobe pairs $12_2$, $12_4$, and $12_6$ are provided on the leftintake cam shaft 3 for controlling the intake valves 11 of the left bank of cylinders, i.e. respectively the two intake valves 11 for the number 2 cylinder, the two intake valves 11 or the number 4 cylinder, and the two intake valves 11 for the number 6 cylinder. And, similarly, cam lobe pairs $14_1$, $14_3$, and $14_5$ are provided on the right intake cam shaft 4 for controlling the intake valves 13 of the right bank of cylinders, i.e. respectively the two intake valves 13 for the number 1 cylinder, the two intake valves 13 for the number 3 cylinder, and the two intake valves 13 for the number 5 cylinder. And cam shaft driving cogged pulleys 17 and 18 are provided as fixedly mounted to the front ends of the left bank intake cam shaft 3 and the right bank intake cam shaft 4, respectively, being secured thereto by bolts 15 and 16 respectively. Although it is not so shown in the drawings, these cogged pulleys 17 and 18 are driven from the crank shaft of the internal combustion engine at half engine speed and in predetermined phase relationships therewith via a toothed timing belt passed around said cogged pulleys 17 and 18, in a per se known manner. And the cogged pulleys 17 and 18 directly rotationally drive the left intake cam shaft 3 and the right bank intake cam shaft 4, respectively, both in the clockwise direction as seen in FIG. 2.

Similarly, cam lobe pairs $22_2$, $22_4$, and $22_6$ are provided on the left exhaust cam shaft 5 for controlling the exhaust valves 21 of the left bank of cylinders, i.e. respectively the two exhaust vales 21 for the number 2 cylinder, the two exhaust valves 21 for the number 4 cylinder, and the two exhaust valves 21 for the number 6 cylinder. And, similarly, cam lobe pairs $24_1$, $24_3$, and $24_5$ are provided on the right exhaust cam shaft 6 for controlling the exhaust valves 23 of the right bank of cylinders, i.e. respectively the two exhaust valves 23 for the number 1 cylinder, the two exhaust valves 23 for the number 3 cylinder, and the two exhaust valves 23 for the number 5 cylinder. At an intermediate position along the left intake cam shaft 3 there is integrally formed therewith a driving gear 25, and at a corresponding intermediate position along the left exhaust cam shaft 5 there is integrally formed therewith a driven gear 26, which has the same number of teeth as the driving gear 25 and is meshed therewith so as to be driven thereby. Accordingly, the left exhaust cam shaft 5 is rotationally driven from the left intake cam shaft 3 in a fixed phase relationship therewith and so as to turn in the anticlockwise direction as seen in FIG. 2. Similarly, at an intermediate position along the right intake cam shaft 4 there is integrally formed therewith a driving gear 27, and at a corresponding intermediate position along the right exhaust cam shaft 6 there is integrally formed therewith a driven gear 28, which has the same number of teeth as the driving gear 27 and is meshed therewith so as to be driven thereby. Accordingly, the right exhaust cam shaft 6 is rotationally driven from the right intake cam shaft 4 in a fixed phase relationship therewith and so as to turn in the anticlockwise direction as seen in FIG. 2.

Further, in FIG. 1, the reference numerals 31 denote spark plug fitting holes, and the reference numerals 32 denote (some of the) valve lifters for the intake and the exhaust valves.

Now, as will be suggested by inspection of FIG. 1, in fact the left intake cam shaft 3 and the right intake cam shaft 4 are identical in configuration, but are reversed, front to back, in the axial direction, i.e. in the direction of the line of cylinders of the engine (or of the engine crank shaft); so the front end 29 of said left intake cam shaft 3, to which the driving cogged pulley 17 is fixed and which is adapted for such fixing, corresponds to the rear end 29' of said right intake cam shaft 4 to which no pulley is fixed by which in any case is adapted for fitting a pulley thereto, and similarly the rear end 30 of said left intake cam shaft 3, to which no pulley is fixed but which in any case is adapted for fitting a pulley thereto, corresponds to the front end 30' of said right intake cam shaft 4, to which the driving cogged pulley 18 is fixed and which is adapted for such fixing. And the axially intermediate position on the left intake cam shaft 3 at which the driving gear 25 is integrally formed thereon corresponds in an axially reversed sense to the axially intermediate position on the right intake cam shaft 4 at which the driving gear 27 is integrally formed thereon. Further, on the left intake cam shaft 3 there is formed near the front end 29 thereof a distributor driving gear 20, which is engaged to a distributor driven gear 19 for driving a distributor, not shown, of the engine; and similarly on the right intake cam shaft 4 there is formed near the rear end 29' thereof a distributor driving gear 20', which does not serve any function but only idles, since one distributor is provided for this internal combustion engine.

Thus, referring to these intake cam shafts, the cam lobes $14_1$ on the right intake cam shaft 4 for the number 1 cylinder correspond to the cam lobes $12_6$ on the left intake cam shaft 3 for the number 1 cylinder, the cam lobes $14_3$ on the right intake cam shaft 4 for the number 3 cylinder correspond to the cam lobes $12_4$ on the left intake cam shaft 3 for the number 4 cylinder, and the cam lobes $14_5$ on the right intake cam shaft 4 for the number 5 cylinder correspond to the cam lobes $12_2$ on the left intake cam shaft 3 for the number 2 cylinder. At this time, with regard to the right intake cam shaft 4 for the right bank of cylinders, we will regard the cam lobes $14_1$ for the number 1 cylinder, the cam lobes $14_3$ for the number 3 cylinder, and the cam lobes $14_5$ for the number 5 cylinder as disposed counter clockwise at intervals of 120° apart as viewed from the side of the number 1 cylinder, in other words as viewed from the front of the engine. And similarly, with regard to the left intake cam shaft 3 for the left bank of cylinders, since it is an identical part but fitted in a reversed fashion, front to back, the cam lobes $12_2$ for the number 2 cylinder, the cam lobes $12_4$ for the number 4 cylinder, and the cam lobes $12_6$ for the number 6 cylinder can be regarded as disposed counter clockwise at intervals of 120° apart as viewed from the side of the number 2 cylinder, in other words again as viewed from the front of the engine.

The situation with regard to the exhaust cam shafts 5 and 6 is analogous. In detail, the left exhaust cam shaft 5 and the right exhaust cam shaft 6 are identical in configuration, but are reversed, front to back, in the axial direction, i.e. in the direction of the line of the cylinders of the engine (or of the engine crank shaft); so that the axially intermediate position on the left exhaust cam shaft 5 at which the driven gear 26 is integrally formed thereon corresponds in an axially reversed sense to the axially intermediate position on the right exhaust cam shaft 6 at which the driven gear 28 is integrally formed thereon. And, further, referring to these exhaust cam shafts, th cam lobes $24_1$ on the right exhaust cam shaft 6 for the number 1 cylinder correspond to the cam lobes $22_6$ on the left exhaust cam shaft 5 for the number 1 cylinder, the cam lobes $24_3$ on the right exhaust cam shaft 6 for the number 3 cylinder correspond to the cam lobes $22_4$ on the left exhaust cam shaft 5 for the number 4 cylinder, and the cam lobes $24_5$ on the right exhaust cam shaft 6 for the number 5 cylinder correspond to the cam lobes $22_2$ on the left exhaust cam shaft 5 for the number 2 cylinder. At this time, with regard to the right exhaust cam shaft 6 for the right bank of cylinders, we will regard the cam lobes $24_1$ for the number 1 cylinder, the cam lobes $24_3$ for the number 3 cylinder, and the cam lobes $24_5$ for the number 5 cylinder as disposed counter clockwise at intervals at 120° apart as viewed from the side of the number 1 cylinder, in other words as viewed from the front of the engine. And similarly, with regard to the left exhaust cam shaft 5 for the left bank of cylinders, since it is an identical part but fitted in a reversed fashion, front to back, the cam lobes $22_2$ for the number 2 cylinder, the cam lobes $22_4$ for the number 4 cylinder, and the cam lobes $22_6$ for the number 6 cylinder can be regarded as disposed counter clockwise at intervals of 120° apart as viewed from the side of the number 2 cylinder, in other words agains as viewed from the front of the engine.

Figure 4:
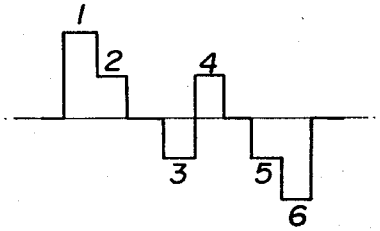
FIG. 4 is a schematic crank diagram for said engine.
Figure 3:
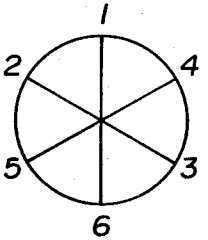
FIG. 3 is a schematic crank angle diagram for said engine, showing firing order and phase.

The disposition of the crank shaft evolves as shown in FIGS. 3 and 4, according to the arrangements as described above of the left intake cam shaft 3, the right intake cam shaft 4, the left exhaust cam shaft 5, and the right exhaust cam shaft 6. The intake valves and the exhaust valves open at regular intervals in the right cylinder bank in the cylinder sequence: number 1 cylinder—number 3 cylinder—number 5 cylinder; and in the left cylinder bank in the cylinder sequence: number 2 cylinder—number 4 cylinder—number 6 cylinder. Accordingly, combined firing at regular intervals in the cylinder sequence: number 1 cylinder—number 2 cylinder—number 3 cylinder—number 4 cylinder—number 5 cylinder—number 6 cylinder becomes possible. Thus, the normal firing sequence for a V type six cylinder engine with a cylinder bank angle of 60° becomes available.

Figure 5:
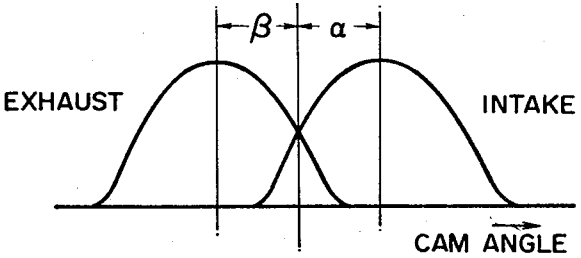
FIG. 5 is a valve lift curve showing exemplary opening and closing performances for an intake and an exhaust valve of said engine.

Now, because the left intake cam shaft 3 and the right intake cam shaft 4 have been made as identical and therefore interchangable and are fitted to the respective left and right cylinder heads 1 and 2 in reversed orientations, and because similarly the left exhaust cam shaft 5 and the right exhaust cam shaft 6 have been made as identical and therefore interchangable and likewise are fitted to the respective left and right cylinder heads 1 and 2 in reversed orientations, it is a requirement that the valve opening profiles of the cam lobes on these cam shafts should be identical to the valve closing profiles thereof, in other words that the rising side of each of the cam lobes should be identical in shape (but reversed) to its dropping side. With symmetrical cam lobes of this sort, the typical valve lift curves for the intake and the exhaust valves become as exemplarily shown in FIG. 5.

For achieving the goal of interchangability of the intake cam shafts 3 and 4 for the left and right cylinder banks as well as of the exhaust cam shafts 5 and 6 for said left and right cylinder banks, it is further necessary, in order to provide appropriate valve opening and closing timings for the intake valves and for the exhaust valves, to set a phase difference for each of the intake cam shafts and the exhaust cam shafts of the right and left cylinder banks. In other words, phase differences of a fixed number n of teeth must be set on the pair of gears 25 and 26 of the left cyliner bank and on the pair of gears 27 and 28 of the right cylinder bank. This number n is required of course to be an integer, and may be determined according to the expression:

$$n = (\text{gamma}/180)N$$

where:

n is the phase difference of the pair of gears expressed as a number of teeth, gamma is the phase angle of the intake cam shaft and the exhaust cam shaft, and N is the number of teeth on each of gears 25, 26, 27, and 28 (these gears are all of identical teeth number).

This equation for the number of teeth of phase difference may be derived as follows, where the symbols denote various angles as shown in FIG. 2:

$$A = 90° - \text{beta} - \text{phi}$$

$$B = 90° + \text{alpha} - \text{theta}$$

$$C = 60° - \text{alpha}$$

$$D = 60° + \text{beta}$$

Therefore:

$$\begin{aligned} x &= B + (\text{theta} - C) - 90° \\ &= 90° + \text{alpha} - \text{theta} + \text{theta} - (60° - \text{alpha}) - 90° \\ &= 2 \cdot \text{alpha} - 60° \\ y &= 90° - (D - A - \text{phi}) + 180° \\ &= 90° - 60° - \text{beta} + 90° - \text{phi} + \text{phi} - \text{beta} + 180° \\ &= 300° - 2 \cdot \text{beta} \end{aligned}$$

And the difference between x and y is:

$$y - x = (300° - 2.\text{beta}) - (2.\text{alpha} - 60°) = 360° - 2.(\text{alpha} + \text{beta})$$

Accordingly as a condition for the cam shafts to be interchangable:

$$y-x=(360°/N)n'$$

where n' is the number of gear teeth by which the left bank and the right bank are displaced from one another. Therefore:

$$360°-2.(\text{alpha}+\text{beta})=(360°/N)n'$$

so $$180°-(\text{alpha}+\text{beta})=(180°/N)n'$$

so, setting alpha+beta equal to gamma in this:

$$180°-\text{gamma}=(180°/N)n'$$

whence $$n'=(180°-\text{gamma}/180°)N$$

which transposed gives:

$$(N-n')B=\text{gamma}/180° \quad (1)$$

n' is the displaced amount of the teeth, and so, using n for $N-n'$, i.e. considering the displaced amount the other way around the gear wheels, equation (1) becomes:

$$n/N=\text{gamma}/180°$$

so $$n=(\text{gamma}/180°)N$$

results.

As an example, if gamma is 120°, and the number N of teeth on each of the gears is 48, then the number n of teeth of phase difference is equal to 32. In this case, considering the right cylinder bank as a datum, if the timing mark Mi of the gear wheel 27 of the intake cam shaft 4 of said right cylinder bank and the timing mark Me of the gear wheel 28 of the exhaust cam shaft 6 of said right cylinder bank are in register as illustrated in FIG. 2, then, considering the left cylinder bank, the engagement of the gear wheels 25 and 26 of the intake and exhaust cam shafts 3 and 5 thereof should be so shifted that the timing mark Mi of the gear wheel 25 of the intake cam shaft 3 and the timing mark Me of the gear wheel 26 of the exhaust cam shaft 5 become displaced from one another by 32 teeth.

Thus, according to the above described structure, the engine is capable of effectuating the correct firing sequence for firing at regular intervals, while using two substantially indentically formed intake cam shafts and two substantially identically formed exhaust cam shafts, one of each being used in the left cylinder bank and the other being used in the right cylinder bank in opposite alignment. And this is done by establishing, in the manner defined above, phase differences between the pairs of gears driving the driven ones of the intake and the exhaust cam shafts from the driving ones thereof. Accordingly, as described above, there is provided a configuration for a V type double overhead cam shaft engine which allows the two intake cam shafts for the left and right cylinder banks to be made as mutually interchangable parts, and likewise allows the two exhaust cam shafts to be made as mutually interchangable parts, and still preserves correct valve timing. Thus, this configuration reduces the number of different parts required for the engine, accordingly making engine manufacture easier and less prone to error. Thus, the engine manufacture is made more economical, as is the stocking of engine parts. Further, the likelihood of engine parts stocking errors is reduced.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, although in the shown preferred embodiment it is the intake cam shafts 3 and 4 which are the ones of the cam shafts which are driven from the engine crank shaft, and the exhaust cam shafts 5 and 6 are driven from said intke cam shafts 3 and 4, nevertheless, in another possible embodiment, this arrangement could be reversed. Other modifications are also possible. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. A configuration for a V type double overhead cam shaft engine comprising a crank shaft, a left cylinder bank with a left bank cylinder head, and a right cylinder bank with a right bank cylinder head, wherein:

(a) a left bank intake cam shaft is fitted to said left bank cylinder head and a right bank intake cam shaft is fitted to said right bank cylinder head, said left bank intake cam shaft being substantially identically formed to said right bank intake cam shaft and being fitted in reversed alignment thereto;

(b) a left bank exhaust cam shaft is fitted to said left bank cylinder head and a right bank exhaust cam shaft is fitted to said right bank cylinder head, said left bank exhaust cam shaft being substantially identically formed to said right bank exhaust cam shaft and being fitted in reversed alignment thereto;

(c) a pair of the same type of said cam shafts are driven in a determinate phase relationship with said engine crank shaft;

(d) a pair of left bank gears, with the same number of teeth, are provided one on said left bank intake cam shaft and one on said left bank exhaust cam shaft, and mesh together so as to rotationally couple together said left bank intake cam shaft and said left bank exhaust cam shaft in a determinate phase relationship;

(e) a pair of right bank gears, with the same number of teeth, are provided one on said right bank intake cam shaft and one on said right bank exhaust cam shaft, and mesh together so as to rotationally couple together said right bank intake cam shaft and said right bank exhaust cam shaft in a determinate phase relationship; and (f) at said left cylinder bank and at said right cylinder bank, the number n of teeth of the phase difference of said pairs of gears is determined by the equation:

$$n=(\text{gamma}/180°)N$$

where gamma is the phase difference angle of the intake cam shaft and the exhaust cam shaft, and N is the number of teeth on the gears.

2. A configuration for a V type double overhead cam shaft engine according to claim 1, wherein said engine is a six cylinder engine, with three cylinders in each of said left and right cylinder banks.

* * * * *